United States Patent [19]

Westin

[11] Patent Number: 4,665,585

[45] Date of Patent: May 19, 1987

[54] LINK ARRANGEMENT

[75] Inventor: Jan E. Westin, Hallsberg, Sweden

[73] Assignee: Ege Westin AB, Hallsberg, Sweden

[21] Appl. No.: 802,259

[22] Filed: Nov. 27, 1985

[30] Foreign Application Priority Data

Jan. 9, 1985 [SE] Sweden ..... 8500080

[51] Int. Cl.[4] ..... E04F 10/00

[52] U.S. Cl. ..... 16/302; 16/267; 160/72

[58] Field of Search ..... 16/257, 254, 249, 271, 16/282, 302, 267; 160/65, 72, 81

[56] References Cited

U.S. PATENT DOCUMENTS

| | | | |
|---|---|---|---|
| 1,144,057 | 6/1915 | Pearson et al. | 16/249 |
| 1,717,922 | 6/1929 | Gillet | 160/81 |
| 2,546,590 | 3/1951 | Ferrel | 16/302 |
| 2,618,809 | 11/1952 | Rubinoff | 16/267 |
| 3,091,357 | 5/1963 | Weinhart | 16/267 X |
| 3,416,185 | 12/1968 | Peterson | 16/267 |
| 3,619,853 | 11/1971 | Merrill | 16/271 |
| 3,636,589 | 1/1972 | Jacobsen | 16/257 |
| 3,866,874 | 2/1975 | Upton | 160/72 |
| 4,065,027 | 12/1977 | Ruark | 16/267 X |
| 4,223,421 | 9/1980 | Wassenaar | 16/267 |
| 4,358,871 | 11/1982 | Takai | 16/267 |

*Primary Examiner*—Jimmy C. Peters

*Attorney, Agent, or Firm*—Dennison, Meserole, Pollack & Scheiner

[57] ABSTRACT

In framework sections for awnings link arrangements are used in which the link bodies are connected to each other by means of cotter pins or similar devices. According to the invention two link bodies (1 and 2) are joined to each other by means of a hook (15, 16, 17) and an eye (6,7,8) so shaped that the two link bodies (1 and 2) are movable in relation to each other in transverse direction only in a predetermined relative position and that the two link bodies are pivotable in relation to each other.

6 Claims, 9 Drawing Figures

LINK ARRANGEMENT

The present invention relates to a link arrangement, preferably for framework sections for awnings.

Curved awnings are arranged on framework sections, each end of these sections being secured to a link arrangement in the nature of a hinge for attachment to the wall of a building or the like. Such link arrangements have hitherto consisted of cast link elements connected by cotter pins or other extra elements which are subsequently bent or locked to the link in some other way. These link elements are expensive and complicated to manufacture, as well as being laborious to assemble.

The object of the present invention is to provide a link arrangement which is simple and inexpensive to manufacture, as well as being simple to assemble without extra connecting parts such as cotter pins or the like. According to the invention this is achieved by the link arrangement consisting of two or more link bodies connected together, comprising a part provided with an aperture into which a hooked part of an adjacent link body is inserted, whereupon locking is effected.

Further characteristic features of the present invention are revealed in the following claims.

Figure 1A:
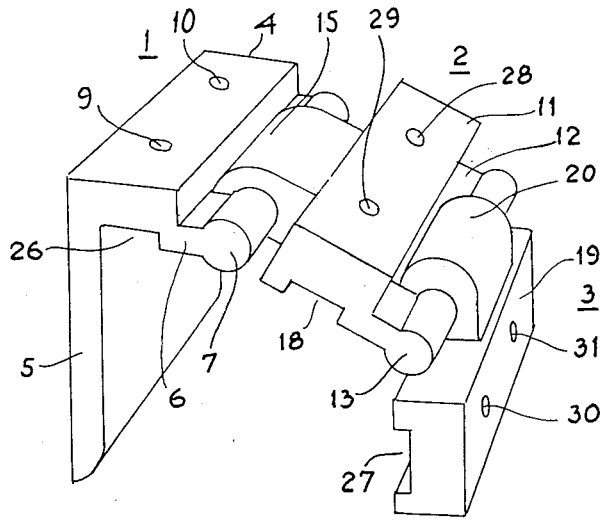
Figure 1B:
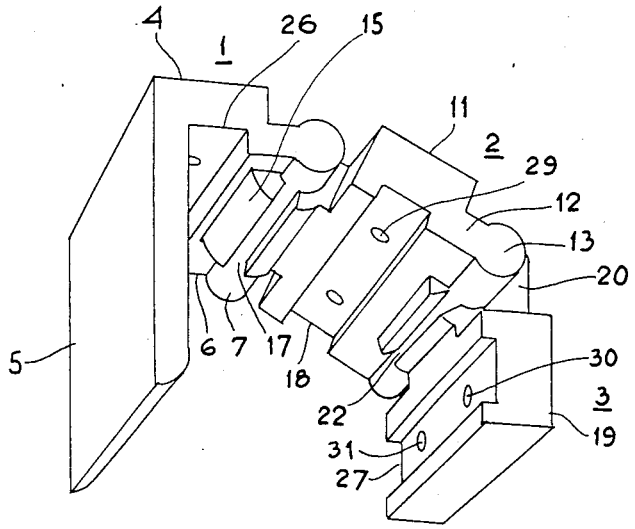
Figure 2A:
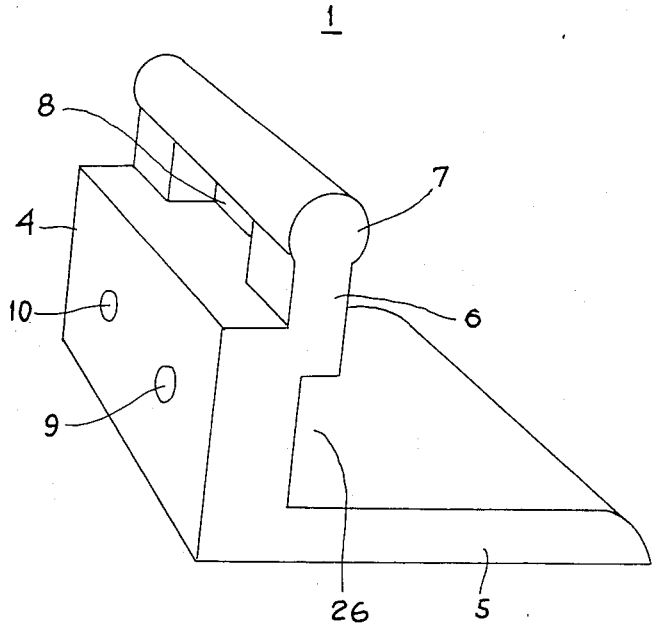
Figure 2B:
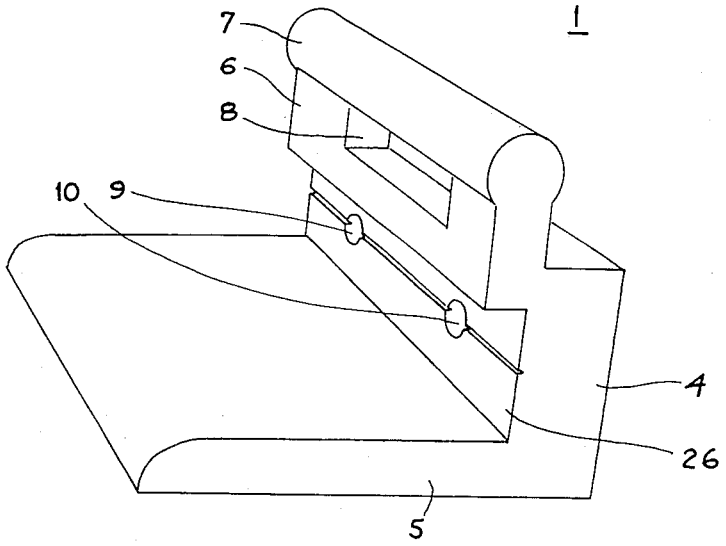
Figure 3A:
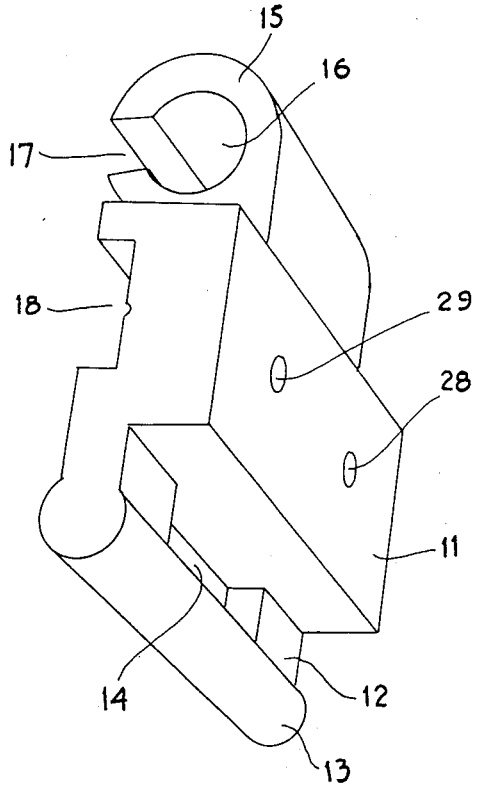
Figure 3B:
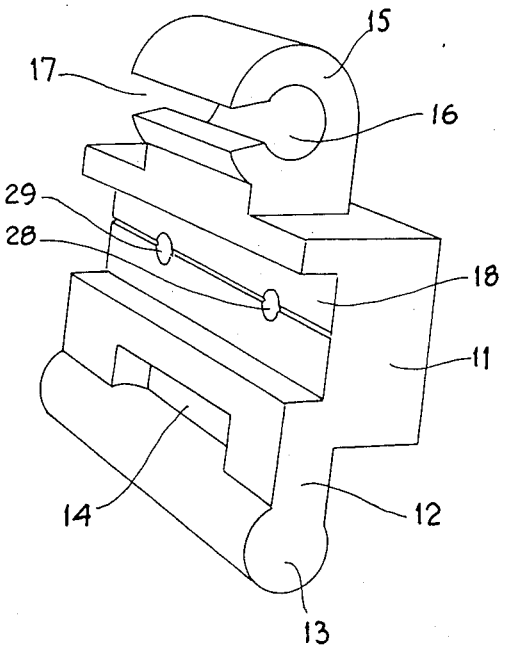
Figure 4A:
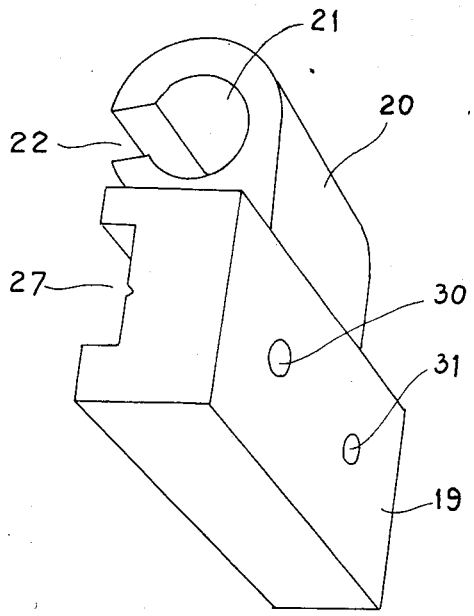
Figure 4B:
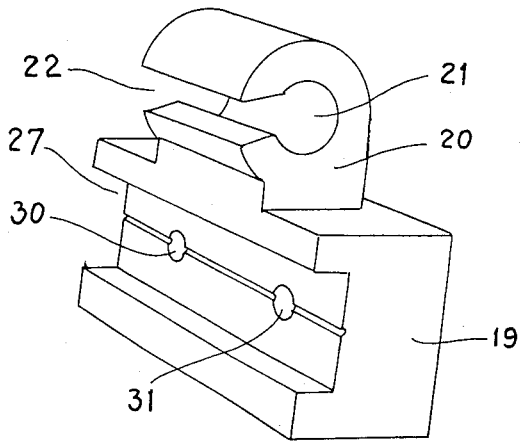
Figure 5:
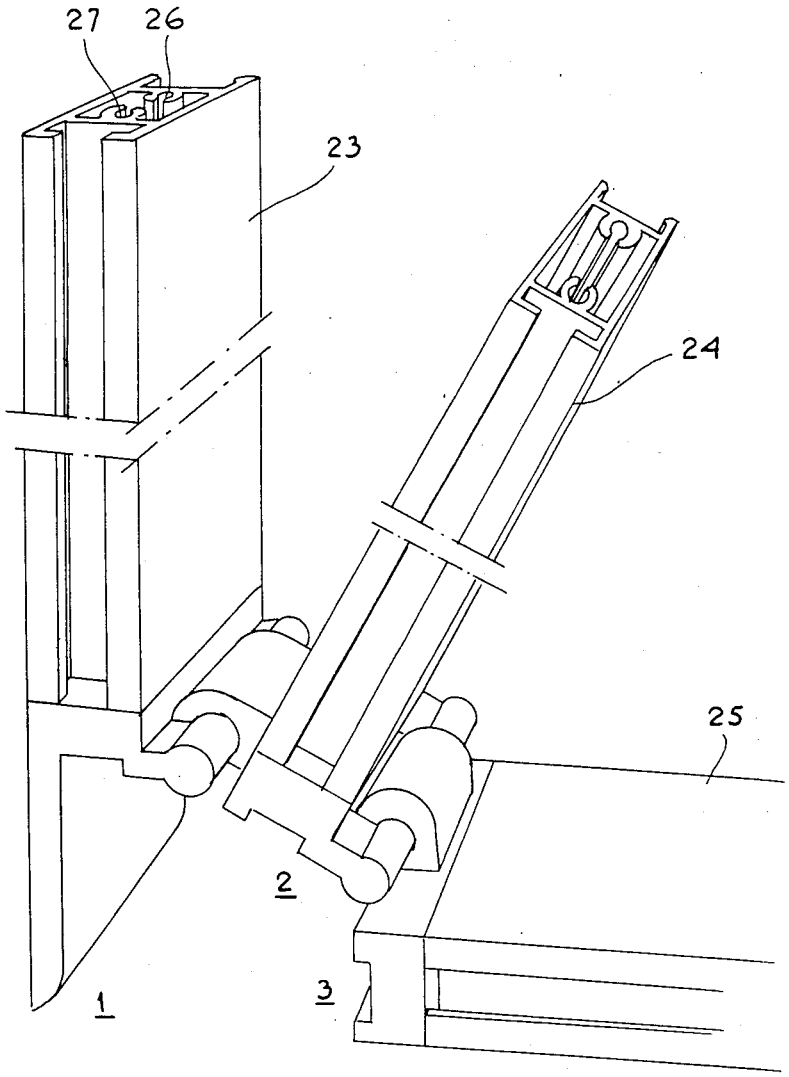

A preferred embodiment of the invention will now be described with reference to the accompanying drawings in which FIGS. 1A and 1B show a link arrangement according to the invention, seen from above and below, respectively, FIGS. 2A and 2B are generally opposed perspective views of a first link, FIGS. 3A and 3B are generally opposed perspective views of a second link, FIGS. 4A and 4B are generally opposed perspective views of a third link, and FIG. 5 shows a link arrangement on which framework sections for awnings are arranged.

In the drawings 1, 2, and 3 denote a first, second and third link body. The link body 1 consists of a parallelepipedic body 4 with a flat part 5 arranged along one long side. The body 4 and part 5 together form an L-section. At the opposite long side of the body 4 is a part 6 provided with an aperture, as shown in FIGS. 2A and 2B, for instance. The part 6 consists of a flat part the same length as the parallelepipedic body and parallel to said body, a cylindrical rod 7 being provided on the free long side of said flat part. The rod 7 is the same length as the flat part and its axis is parallel to the longitudinal direction of said part. A long, narrow aperture 8 is provided on the flat part said aperture defining an eye, close to the cylindrical rod with the flat part 6 divided into a pair of spacers, one to each side of the aperture 8, forming two spacers interconnecting the body 4 and the rod 7. Similarly, the link body 2 consists of a parallelepipedic body 11 provided with an apertured part 12 defining an eye in the same way as for the link body 1. On the long side of the body 11 opposite to that on which the part 12 with aperture is arranged, is a part 15 provided with a hook, as shown in FIGS. 3A and 3B. The hooked part 15 consists of a tubular part 16, its axis arranged parallel to the longitudinal direction of the body 11 and having an internal diameter equal to or slightly exceeding the diameter of said cylindrical rod 7. A slit 17 is provided along the tubular part 16, parallel to its axis. If the link body 2 is viewed from the side, as in FIG. 3A, and the hooked part 15 faces left, the slit 17 is on the lower side of the tubular part, preferably fairly close to the parallelepipedic body 11, so that a hook is formed. The width of the slit exceeds the thickness of the flat part of the part 6 provided with the aperture 8, but is less than the diameter of its cylindrical rod 7. Furthermore, the length of the tubular part 16 in the direction of its axis, and its wall thickness, are such that the hook formed fits into said aperture 8 in the part 6 on an adjacent link body 1. The link body 3 also consists of a parallelepipedic body 19 provided with a hooked part 20 in the same way as for the link body 2. All the link bodies are provided with a recess, respectively 26, 18 and 27. If the various link bodies are viewed from the side, as in FIGS. 2A, 3A and 4A, these recesses face down and extend in the longitudinal direction of the bodies 4, 11 and 19. From these recesses transverse screw holes 9, 10, 28, 29, 30 and 31 are provided in the bodies 4, 11 and 19 to enable framework sections for an awning to be attached, for instance. This application of the link means according to the invention is shown in FIG. 5, where the framework sections are designated 23, 24 and 25. Screw recesses 26 and 27 are arranged in the framework sections, to align with the screw holes in the link bodies.

The link arrangement according to the invention may be manufactured in any desired material. If the arrangement is to be used in awnings for outdoor use, a corrosion-free material such as plastic or aluminium is preferred. Each link body is preferably made in one piece. Manufacture of the link arrangement becomes even simpler and less expensive if the various link bodies are produced in the form of rods which are then cut in desired lengths. This enables manufacturing costs to be halved in comparison with cast bodies.

The link arrangement is assembled by inserting the hooked part 15 or 20 of a link body 2 or 3 into the aperture of part 6 of an adjacent link body 1 to be secured to a wall, for instance, by means of the flat part 5. If a link body 2 is selected, further link bodies 2 or a link body 3 may be connected. The last body in the link change is preferably a link body 3, but a link body 2 is also possible. A hooked part 15 or 20 is slipped over a part 6 from the side. When the hook is above the aperture 8 the bodies can be turned in relation to each other since the hook will then pass through the aperture. A self-locking construction is obtained by selecting the relative dimensions of adjacent parts as described above.

The link arrangement according to the invention has been described for use with framework sections for awnings. However, it should be evident that it can also be used for other applications requiring hingelike link arrangements.

I claim:

1. A link arrangement, preferably for framework sections for awnings, wherein said link arrangement comprises a number of link bodies connected together, a first link body at one end of the link arrangement including means for anchoring said link arrangement, a further link body at the other end of the link arrangement, and at least one intermediate link body, eye means on each of two of said link bodies, hook means on the third link body and on one of said first two link bodies cooperating with and engaging said eye means and pivotally joining adjacent link bodies, said hook means and eye means being so shaped that transverse relative movement between the two pivotally joined link bodies is possible only in a predetermined position, each hook means comprising a tubular portion with a slit defined longitudinally therethrough, each eye means comprising an aperture defined between a pair of laterally spaced spacers secured to and extending from an adjoining link body, and a cylindrical body secured to and between said spacers outward of the corresponding link body, each said hook means engaging within the corresponding aperture between the spacers with the cylindrical body transversely slidably received within the corresponding tubular portion and, upon alignment of the hook means and aperture, rotatable relative thereto.

2. A link arrangement according to claim 1, wherein said further link body and said intermediate link body are interchangeably engageable with said first link body.

3. A link assembly comprising multiple interengaging link bodies including at least first, second and third link bodies, said first link body including anchor means for mounting the first link body to a support structure, pivotally cooperating first hook and eye elements on said first and third link bodies for a selective pivotal linking of said first and third link bodies, said second link body including second hook and eye elements pivotally engageable respectively with the eye and hook elements on said first and third link bodies for selective pivotal linking of said second link body to and between said first and third link bodies, each eye element comprising an aperture defined by a pair of laterally spaced spacers secured to and extending outward from the corresponding link body, and a cylindrical body secured to and extending between said spacers in outwardly spaced relation to the link body.

4. The link assembly of claim 3 wherein each hook element comprises a tubular portion secured to and positioned transversely of the corresponding link body immediately outward thereof, said tubular portion being of a size to slidably receive a cylindrical body therein for alignment with a corresponding aperture, said tubular portion being receivable within the corresponding aperture for pivotal rotation about the cylindrical body.

5. The link assembly of claim 4 wherein the tubular portion of each hook element has a slit defined longitudinally therethrough, said slit being of a width comprising a minor portion of the circumference of the tubular portion and being only sufficient to closely receive the spacers of a cooperating eye element therethrough upon alignment therewith for sliding reception of the corresponding cylindrical body within the tubular portion, whereby rotation of the hook element tubular portion into the aperture will move the slit out of alignment with the spacers and preclude withdrawal of the cylindrical body from the tubular portion.

6. The link assembly of claim 5 wherein said first eye element is on said first link body, said first hook element being on said third link body.

* * * * *